US008761958B2

(12) United States Patent
Rossi

(10) Patent No.: US 8,761,958 B2
(45) Date of Patent: Jun. 24, 2014

(54) METHODS AND DEVICES USED FOR AUTOMATICALLY CONTROLLING SPEED OF AN EXPANDER

(75) Inventor: David Rossi, Florence (IT)

(73) Assignee: Nuovo Pignone S.p.A., Florence (IT)

( * ) Notice: Subject to any disclaimer, the term of this patent is extended or adjusted under 35 U.S.C. 154(b) by 366 days.

(21) Appl. No.: 13/204,671

(22) Filed: Aug. 6, 2011

(65) Prior Publication Data

US 2012/0039724 A1 Feb. 16, 2012

(30) Foreign Application Priority Data

Aug. 11, 2010 (IT) ..... CO2010A0044

(51) Int. Cl.
*F16L 55/04* (2006.01)

(52) U.S. Cl.
USPC ..... 700/304; 700/290

(58) Field of Classification Search
CPC ..... F01D 17/24
USPC ..... 700/304, 290; 60/39.17; 62/55.5, 612, 62/613, 656, 657; 415/1, 13, 16, 19, 30; 416/30–34, 40, 115; 418/1
See application file for complete search history.

(56) References Cited

U.S. PATENT DOCUMENTS 4,173,870 A 11/1979 Swearingen et al.
4,700,081 A 10/1987 Kos et al.
5,386,708 A * 2/1995 Kishorenath et al. ..... 62/55.5
2007/0151243 A1 7/2007 Stewart
2009/0232663 A1 9/2009 Mirsky et al.
2011/0030392 A1* 2/2011 Borchers et al. ..... 62/55.5

FOREIGN PATENT DOCUMENTS

EP 0352064 A1 1/1990
EP 2124004 A2 11/2009
EP 2196659 A1 6/2010
JP 61210223 A 9/1986
WO 2008144307 A1 11/2008
WO 2009030511 A1 3/2009

OTHER PUBLICATIONS

Search Report issued Jul. 19, 2011 in connection with corresponding IT Application No. CO2010A000043.
Search Report issued Jul. 19, 2011 in connection with IT Application No. CO2010A00044.

* cited by examiner

*Primary Examiner* — Mohammad Ali
*Assistant Examiner* — Emilio J Saavedra
(74) *Attorney, Agent, or Firm* — Global Patent Operation

(57) ABSTRACT

A method of controlling a transition time through a speed range that is unsafe for an integrity of a second expander that receives a fluid flow from a first expander, by automatically biasing a speed of the second expander is provided. The method includes setting the speed of the second expander to be smaller than a current speed of the first expander. The method also includes setting the speed of the second expander to be larger than the current speed of the first expander, when the current speed of the first expander is within the bias application range, and the current speed of the second expander increases and is larger than the first speed value, or decreases and is larger than the second speed value.

21 Claims, 9 Drawing Sheets

METHODS AND DEVICES USED FOR AUTOMATICALLY CONTROLLING SPEED OF AN EXPANDER

BACKGROUND OF THE INVENTION

1. Field of the Invention

Embodiments of the subject matter disclosed herein generally relate to methods and devices that automatically set a speed of an expander, which receives a fluid flow output from another expander to be positively or negatively biased, in order to decrease a transition time through a speed range that is unsafe for the integrity of one of the expanders.

2. Description of Related Art

In gas and oil refrigeration systems, often two expanders are arranged in series, and are used to cool a refrigerant gas. This refrigerant gas is a cooling agent for liquefying the natural gas. FIG. 1 is a schematic diagram of a conventional two expander assembly 1. A gas flow output from a first expander 10 enters a second expander 20, the "first" and "second" labels being related to expanders' positions in a flow direction 30.

The first expander 10 typically receives gas having a high pressure at room temperature, and outputs gas having a low pressure and a low temperature. The second expander 20 receives the gas output from the first expander 10 and proceeds cooling the gas. The first expander 10 and the second expander 20, which expand the gas, have rotating impellers 22 and 24, respectively. During normal operation, when there are no concerns related to avoiding a speed range for one of the expanders, a regulator 40 sets a rotating speed of the impeller 24 of the second expander 20 to be the same as a current rotating speed of the impeller 22 of the first expander 10. The regulator 40 may receive information on the current speed of the first expander 10 from a speed sensor (Sv1) 50.

In the following description, the term "speed" includes "rotating speed," and the term "speed of an expander" is used instead of repeatedly specifying "speed of an impeller of an expander." The speeds of the expanders 10 and 20 are related to a gas flow passing therethrough, the speeds increasing when the gas flow increases.

As known in the art, for an expander, there is usually at least one undesirable operating speed. When the expander functions at the undesirable operating speed for an extended time, damage is more likely to occur than when operating at other operating speeds, for example, because excessive vibrations occur at the undesirable speed due to a resonance phenomenon. Therefore, operators try to avoid operating the expanders at the undesirable speed, by controlling the expanders such as to operate as short time as possible, in an undesirable range around the undesirable speed.

Conventionally, in order to avoid operating one of the first expander 10 or the second expander 20 in their respective undesirable range, the speed of the second expander 20 is manually set to deviate from the speed of the first expander 10. Setting the speed of the second expander 20 to be different from the speed of the first expander 10 has the effect of changing a distribution of the pressure drop across the expanders. Therefore, the speed of the first expander 10 is affected by the manner in which the speed of the second expander 20 is set. By controlling the set speed of the second expander 20, an operator may indirectly also control the speed of the first expander 10.

The manual operation of the system has the following disadvantages. Manually biasing the set speed of the second expander 20 is associated with high risk of accidentally operating one of the expanders inappropriately. In addition to biasing the speed of the second expander, the operator should control the system to comply with constraints related to a maximum allowed running time inside the undesirable speed range, a maximum allowed rate of a change of the set speed, and a maximum allowed speed difference between the expanders.

Another disadvantage is that, in case of a manual operation, the undesirable range is often defined to be broader than minimum necessary, thereby reducing a normal operating range for the expander.

Manually biasing the speed of the second expander 20 may also result in difficulties in operating the whole system in a controlled manner. For example, the rate of change of the set speed should be maintained smaller than a threshold value in order to allow the two-expander system to achieve equilibrium operating states, instead of operating in potentially harmful and hard to control transition states. When the speed is set manually, this rate of change of the speed may accidentally become too large.

Additionally, a manual operation aimed to decrease a time of operating an expander in an undesirable speed range may distract the operator from the overall monitoring of the system, which may result in a delayed response to unrelated abnormalities that may occur concurrently with the manual operation.

Accordingly, it would be desirable to provide systems and methods that avoid the afore-described problems and drawbacks.

BRIEF SUMMARY OF THE INVENTION

According to one exemplary embodiment, a method of controlling a transition time through a speed range that is unsafe for an integrity of a second expander that receives a fluid flow from a first expander, by automatically biasing a speed of the second expander is provided. The method includes setting the speed of the second expander to be smaller than a current speed of the first expander, when the current speed of the first expander is within a bias application range, and a current speed of the second expander increases and is smaller than a first speed value, or decreases and is smaller than a second speed value. The method also includes setting the speed of the second expander to be larger than the current speed of the first expander, when the current speed of the first expander is within the bias application range, and the current speed of the second expander increases and is larger than the first speed value, or decreases and is larger than the second speed value.

According to another embodiment, a controller includes an interface and a processing unit. The interface is configured to receive information about a current speed of a first expander, and to output a set speed for a second expander, the second expander receiving a fluid flow output from the first expander. The processing unit is connected to the interface and is configured to determine the set speed of the second expander when the current speed of the first expander is within a bias application range. The processing unit is configured to determine the set speed of the second expander to be smaller than the current speed of the first expander when a current speed of the second expander increases and is smaller than a first speed value, or decreases and is smaller than a second speed value. The processing unit is also configured to determine the set speed of the second expander to be larger than the current speed of the first expander when the current speed of the second expander increases and is larger than the first speed value, or decreases and is larger than the second speed value.

According to another embodiment, a device made of electronic components converts a first expander speed signal including a current speed of a first expander into a second expander speed signal including a set speed of a second expander, the second expander receiving a fluid flow from the first expander. The device includes a signal generation block configured to generate the second expander speed signal and a bias switch signal generation block connected to the signal generation block, and configured to generate a bias switch signal. The signal generation block includes an add/subtract circuit configured to subtract a bias value signal to the first expander speed signal, a first path configured to forward the first expander speed signal to the add/subtract circuit, a second path configured to generate a negative bias signal, a third path configured to generate a positive bias signal and a switch connected to outputs of the second path and the third path, and configured to connect the second path or the third path to the add/subtract circuit depending on the bias switch signal. The second path and the third path generate a zero signal, when the current speed of the first expander is outside a bias application range. The bias switch signal generation block is configured to generate the bias switch signal indicating to connect the second path if a current speed of the second expander is smaller than a first value, indicating to connect the third path if the current speed of the second expander is larger than a second value, and to maintain current connection if the current speed of the second expander is larger than the first value and is smaller than the second value.

According to another embodiment, a computer readable medium storing executable codes, which, when executed by a processor, make the computer perform a method of controlling a transition time through a speed range that is unsafe for an integrity of a second expander, by automatically biasing a speed of the second expander that receives a fluid flow output from the first expander. The method includes setting the speed of the second expander to be smaller than a current speed of the first expander, when the current speed of the first expander is within a bias application range, and a current speed of the second expander increases and is smaller than a first speed value, or decreases and is smaller than a second speed value. The method also includes setting the speed of the second expander to be larger than the current speed of the first expander, when the current speed of the first expander is within the bias application range, and the current speed of the second expander increases and is larger than the first speed value, or decreases and is larger than the second speed value.

BRIEF DESCRIPTION OF THE SEVERAL VIEWS OF THE DRAWINGS

The accompanying drawings, which are incorporated in and constitute a part of the specification, illustrate one or more embodiments and, together with the description, explain these embodiments. In the drawings.

DETAILED DESCRIPTION OF THE INVENTION

The following description of the exemplary embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to the terminology and structure of methods and devices used in a two expander system in which a transition time through a speed range that is unsafe for an integrity of one of the expanders is decreased, by automatically biasing a speed of a second expander that receives a fluid flow output by the first expander. However, the embodiments to be discussed next are not limited to these systems, but may be applied to other systems that require avoiding an undesirable speed range of an expander.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Figure 2:
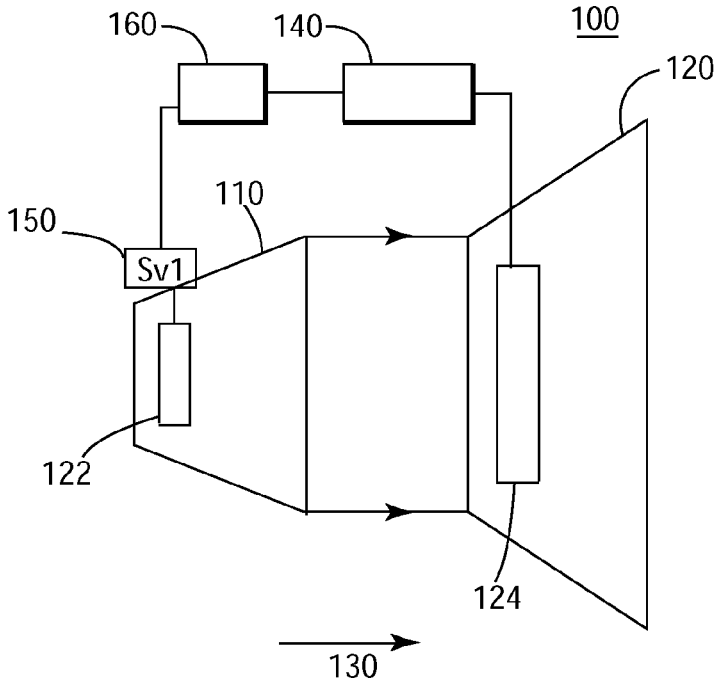
FIG. 2 is a schematic diagram of a two expander assembly according to an embodiment.

FIG. 2 is a schematic diagram of a two expander assembly 100 according to an embodiment. FIG. 2 shows a first expander 110, a second expander 120, an impeller 122 of the first expander 110, an impeller 124 of the second expander 120, a flow direction 130, a regulator 140 setting the speed of the second expander 120 according to a speed value input to the regulator, and a sensor 150 providing information about the current speed of the first expander 110.

According to an embodiment, the two expander system 100 in FIG. 2 further includes a controller 160 mounted between the first expander 110 and the regulator 140. However, the controller 160 may be mounted at other locations. Those skilled in the art would also recognize that the regulator 140 may be modified to include the controller 160 or a processor of the regulator 140 may be configured to perform the functions of the controller 160.

Figure 1:
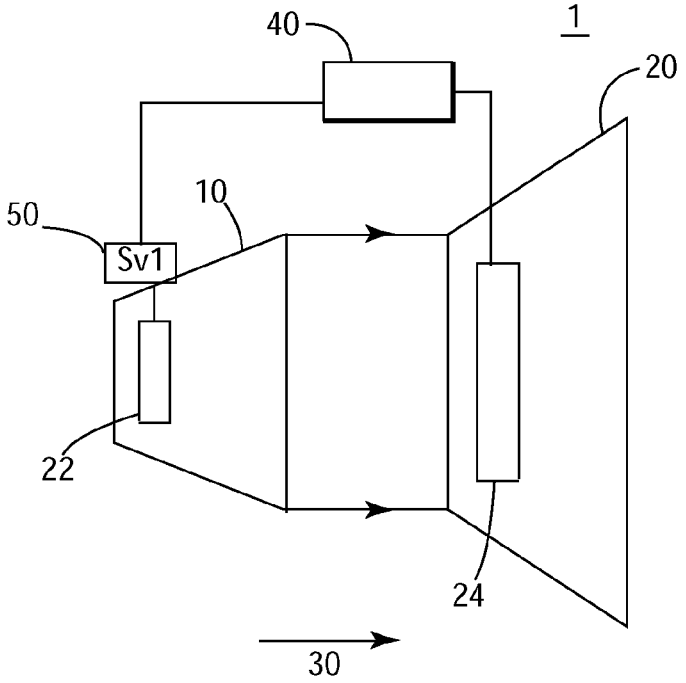
FIG. 1 (Background Art)
FIG. 1 is a schematic diagram of a conventional two expander assembly.

The controller 160 in FIG. 2 receives the information regarding the current speed of the first expander 110, for example, from the speed sensor 150, and provides a speed value to the regulator 140. The regulator 140 sets the speed of the second expander 120 to be equal to the speed value received from the controller 160. In other words, the same regulator as in the conventional system 1 illustrated in FIG. 1 may be used, but in contrast to the conventional system where the regulator 40 receives the current speed of the first expander 10, the regulator 140 of system 100 in FIG. 2 receives the speed value from the controller 160. This speed value may or may not be the same as the current speed of the first expander 110, as discussed below.

Figure 3:
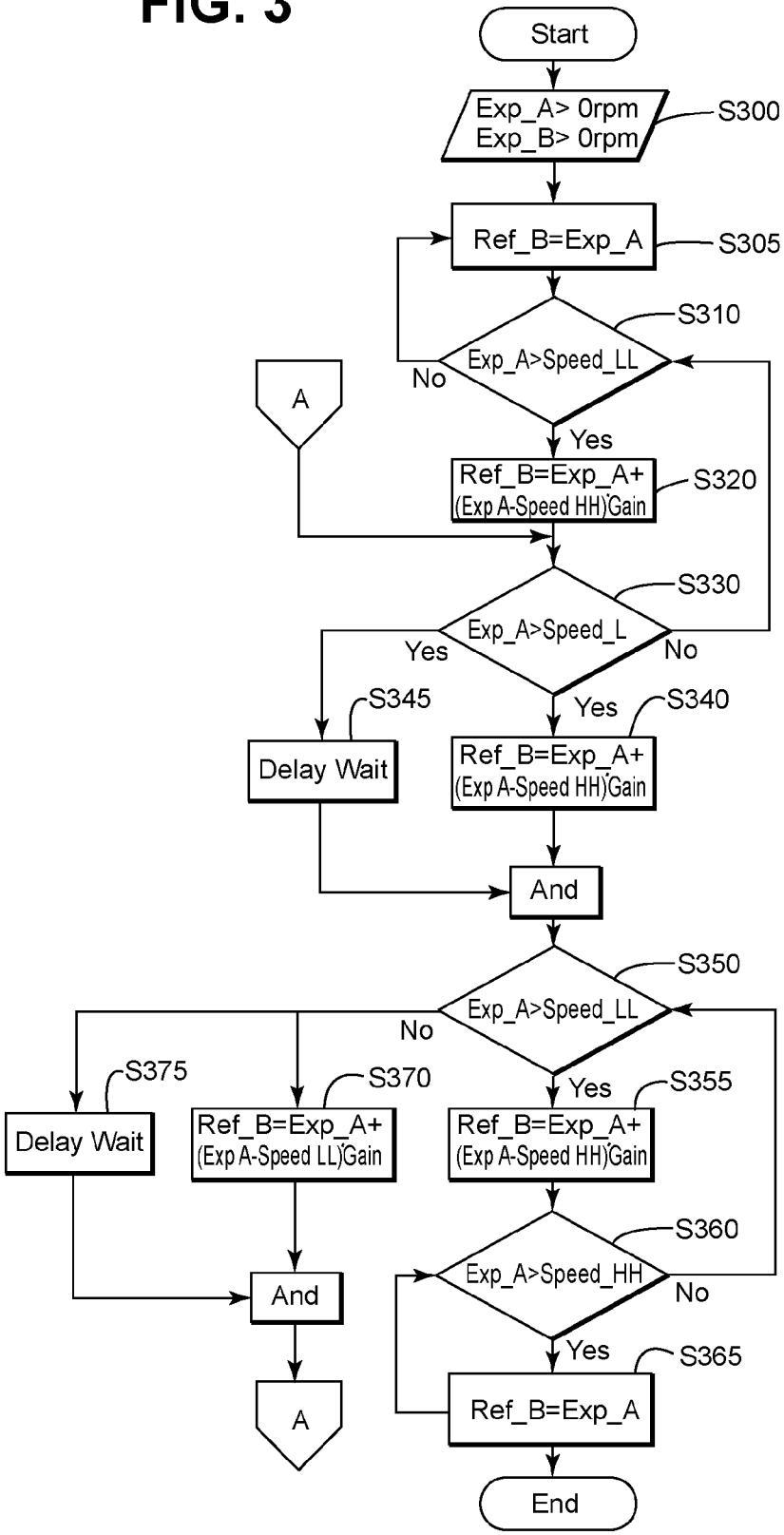
FIG. 3 is a flow diagram of a method of decreasing a transition time through a speed range around an undesirable speed that is unsafe for an integrity of a first expander, according to an embodiment.

FIG. 3 is a flow diagram of a method of decreasing a transition time through a speed range around an undesirable speed that is unsafe for an integrity of the first expander, by automatically biasing a speed of the second expander that receives a fluid flow output by the first expander, according to an embodiment. The graph in FIG. 4 representing speeds of the first expander and the second expander as functions of the gas flow is used next to describe the method in FIG. 3.

Figure 4:
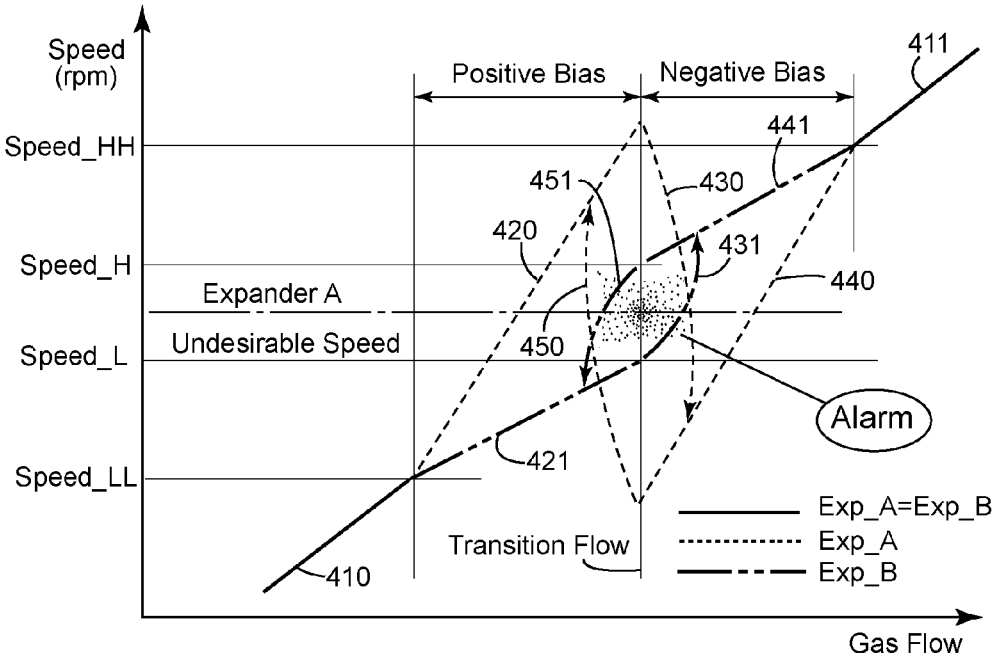
FIG. 4 is a graph representing speeds of the first and the second expander as functions of the fluid flow, according to an exemplary embodiment.

Speed values expressed in some rotational speed units such as, in rotation per minute (rpm) units are illustrated on the y axis of the graph in FIG. 4. Four representative speed values are marked and labeled along the y axis, and these speeds satisfy the following relationships: SPEED_LL<SPEED_L<SPEED_H<SPEED_HH. An undesirable speed of the first expander (UNDESIRABLE SPEED) is a value included in an undesirable speed range, between SPEED_L and SPEED_H. The undesirable range may be specified by the manufacturer or predetermined based on testing and experience.

When the current speed of the first expander is within a bias application range, between SPEED_LL and SPEED_HH, the speed of the second expander is set to be biased, that is, different from the current speed of the first expander. When the current speed of the first expander is outside the bias application range, the speed of the second expander is set to be equal to the current speed of the first expander.

In addition to specifying the undesirable range, manufacturers of expanders usually specify a maximum time (MAX_TIME), which is a maximum time interval during which an expander is allowed to operate at speeds inside the undesirable range. The manufacturers of expanders also usually specify a maximum allowed rate of a speed change (SPEED_RATE) for the expander (e.g., the second expander).

Also, the manufacturer (if the two expander system is provided as a whole by the same manufacturer) or a process engineer (if the two expander system is assembled by a user) determines a maximum allowed speed difference (SPEED_DIFF) between the speeds of the first and second expanders. That is, in the two-expander system (e.g., 100 in FIG. 2), an absolute difference between the speeds of the first expander and the speed of the second expander should be, for normal operating conditions, smaller than a maximum SPEED_DIFF. In order to be able to operate the system such as to comply with this maximum allowed speed difference (SPEED_DIFF) constraint, the maximum allowed speed difference (SPEED_DIFF) should be larger than SPEED_H−SPEED_L.

Absolute values corresponding to the representative speed values labeled on the y axis of the graph in FIG. 3 depend on individual systems. An exemplary set of values for the above identified speed values is: SPEED_LL=16600 rpm, SPEED_L=17600 rpm, UNDESIRABLE SPEED=18000 rpm, SPEED_H=18400 rpm, and SPEED_HH=19400 rpm.

The gas flow through the expanders is represented on the x axis of the graph in FIG. 4. In FIG. 4, the speeds of the expanders have a linear dependence of the gas flow. However, the linear dependence is only an exemplary illustration of a correlation function of the speeds of the expanders with the gas flow. The correlation function may have other functional dependence, but generally, when the gas flow increases the speeds of the expanders increase, and when the gas flow decreases, the speeds of the expanders decrease.

When the system starts operating (i.e., gas starts flowing through the expanders) the speed of the expanders become positive (i.e., greater than 0 rpm), at S300 in FIG. 3. At low the gas flow, while the speed of the expanders are below the bias application range, the speed of the second expander (Ref_B) is set (e.g., by the regulator 140 based on a signal received from the controller 160 in FIG. 2) to be equal with a current speed of the first expander (Exp_A) at step S305. The current speed of the first expander may be received by the controller 160 in FIG. 2, from a speed sensor such as Sv1 150 in FIG. 2. However, information on the current speed of the first expander may be received from other sources of information such as a control panel, estimated, calculated, etc.

As long as the current speed of the first expander (e.g., 110 in FIG. 2) is outside the bias application range (i.e., smaller than SPEED_LL or larger than SPEED_HH), a speed of the second expander (e.g., 120 in FIG. 2) is set (e.g., by the regulator 140 based on the value received from the controller 160 in FIG. 2) to be the same as the current speed of the first expander, situations which correspond to the segments 410 and 411 in FIG. 4.

If a comparison of the current speed of the first expander with the SPEED_LL at step S310 in FIG. 3 indicates that the current speed of the first expander is smaller than SPEED_LL (i.e., the branch NO from S310), the speed of the second expander (Ref_B) is set to be equal with the current speed of the first expander (Exp_A) at step S305.

At a higher gas flow, when the current speed of the first expander (Exp_A) becomes larger than SPEED_LL (i.e., the branch YES from S310), the speed of the second expander (Ref_B) is set to a value larger than the current speed of the first expander at step S320. Specifically, the speed of the second expander is set to be Ref_B=Exp_A+(Exp_A−SPEED_LL)×GAIN, where GAIN is a predetermined positive value. The quantity (Exp_A−SPEED_LL)×GAIN is a positive bias applied to the speed of the second expander. Thus, the positive bias is proportional with a difference between the current speed of the first expander and the lower limit of the bias application range (i.e., SPEED_LL). In other applications, the positive bias may be determined a different manner. In general, the positive bias may be a function of the current speed of the first expander (Exp_A), the lowest value of the bias application range (SPEED_LL), the lowest value of the undesirable speed range (SPEED_L), gain, etc., e.g., f(Exp_A, SPEED_LL, SPEED_L, GAIN).

The GAIN may be predetermined to be a ratio of the maximum allowed speed difference (SPEED_DIFF) and the difference SPEED_H-SPEED_L. An exemplary value of the GAIN is 2.

At S320, when the speed of the second expander is biased, the controller (e.g., 160 in FIG. 2) is configured to output a speed value such that a current rate of change of the speed of the second expander is smaller than the maximum rate of change of the speed for the second expander (SPEED_RATE). The maximum rate of change of the speed for the second expander (SPEED_RATE) may be, for example, a value between 20 and 50 rpm/s, e.g., 40 rpm/s. Thus, even if the gas flow increases at a fast rate, the speed of the second expander is set to increase gradually in time to comply with the maximum allowed rate of change of the speed (SPEED_RATE) constraint.

Due to the positively biased speed of the second expander, the distribution of the pressure drop across the system may change compared to a state when no bias was applied, although the total pressure drop may remain substantially the same. Thus, the current speed of the first expander for a given gas flow becomes smaller than a value of the current speed that the first expander would have had, if no bias were applied to the speed of the second expander at that given gas flow.

As long as the comparison of the current speed of the first expander (Exp_A) with SPEED_L at S330 indicates that the current speed of the first expander is lower than SPEED_L (i.e., the branch NO from S330), and the comparison of the current speed of the first expander with SPEED_LL at S310 indicates that the current speed of the first expander is larger than SPEED_LL, the speed of the second expander (Ref_B) is set to include the positive bias (i.e., to be positively biased).

The speed of the second expander as a function of flow when the speed of the second expander is positively biased corresponds to segment 420 in FIG. 4, and the current speed of the first expander in this situation corresponds to segment 421 in FIG. 4. Note that by applying the positive bias to the speed of the second expander (as illustrated by segment 420), the current speed of the first expander (as illustrated by segment 421) remains smaller than SPEED_L, and, thus, outside the undesirable speed range.

If the comparison of the current speed of the first expander with SPEED_L at S330 indicates that the current speed of the first expander is larger than SPEED_L (i.e., the branches YES from S330), the controller 160 communicates to the regulator 140 a speed value smaller than the current speed of the first expander at step S340, and waits for a delay at S345. Specifically, at S340, the speed of the second expander is set to be Ref_B=Exp_A+(Exp_A−SPEED_HH)×GAIN. The negative bias (Exp_A−SPEED_HH)×GAIN is a negative quantity, and, therefore Ref_B is set to be smaller than Exp_A.

The transition from biasing the speed of the second expander positively to biasing the speed of the second expander negatively may be performed while observing the constraint related to the maximum rate of change of the speed. That is, the rate of change of the speed may be maintained smaller than the maximum value of the rate of change (SPEED_RATE). The transition while observing the constraint related to the maximum rate of change may make necessary intermediary steps before reaching the new target value for the speed of the second expander. Therefore, the delay is observed at S345. By observing this delay, the system reaches a target status (e.g., the current speed of the first expander is larger than SPEED_H, on segment 441 in FIG. 4) before considering setting the speed of the second expander in a different manner.

Given that the speeds of the first and second expanders are correlated with the gas flow, this transition occurs when the gas flow exceeds a TRANSITION FLOW value. This TRANSITION FLOW value may be determined either by calculation or by experimentation for the two-expander system. The TRANSITION FLOW value may depend on the gas composition and the expanders' efficiency, which may change in time. No direct measurement of the gas flow is required, because the TRANSITION FLOW value is a flow value at which when the speed of the second expander is set to be positively biased, the current speed of the first expander becomes equal to a lower limit of the undesirable speed range SPEED_L. If the speed of the second expander is then set negatively biased, even if the gas flow is maintained at the TRANSITION FLOW value, the speed of the first expander will increase up to the upper limit of the undesirable speed range SPEED_H.

This transition from biasing the speed of the second expander positively to biasing the speed of the second expander negatively, may change the pressure drop distribution across the two expander system, which will determine changing the current speed of the first expander to a value equal to or larger than SPEED_H, on segment 441 in FIG. 4. Thus, when the change is completed, the current speed of the first expander should be outside the undesirable range of speed. The delay observed at S345 allows the system to complete the transition.

In some embodiments, if after the delay at S345, the current speed of the first expander is less than SPEED_H, although the gas flow is larger than or equal to the TRANSITION FLOW value, an alarm signal may be issued (e.g., by the controller 160 in FIG. 2).

Since the transition from biasing the speed of the second expander positively to biasing the speed of the second expander negatively likely occurs concurrently with an increase of the gas flow, the current speed of the first expander during the transition is illustrated as dashed arch 431 in FIG. 4, and the speed of the second expander is illustrated as dashed arch 430 in FIG. 4.

As long as, according to a comparison at S350, the current speed of the first expander remains larger than SPEED_H (i.e., the branch YES from S350), but, according to a comparison at S360, is smaller than SPEED_HH (i.e., the branch NO from S360), the speed of the second expander is set to have the negative bias at step S355, that is: Ref_B=Exp_A+(Exp_A−SPEED_HH)×GAIN.

The speed of the second expander as a function of flow in this situation corresponds to segment 440 in FIG. 4, and the current speed of the first expander in this situation corresponds to segment 441 in FIG. 4. Note that by applying the negative bias to the speed of the second expander (as illustrated by segment 440), the current speed of the first expander remains larger than SPEED_H, and, thus, outside the undesirable speed range (as illustrated by segment 441 in FIG. 4).

When, according to the comparison at S360, the current speed of the first expander is larger than SPEED_HH (i.e., the branch YES from S360), the speed of the second expander is set to be equal to the current speed of the first expander, at S365.

If, according to the comparison at S350, the current speed of the first expander is smaller than SPEED_H (i.e., the branch NO from S350), the speed of the second expander is no longer biased negatively, but it is again biased positively (Ref_B=Exp_A+(Exp_A−SPEED_LL)×GAIN) at S370. In order to avoid having the system flipping back and forth between biasing the speed of the second expander positively and negatively, the transition from biasing positively to biasing negatively the speed of the second expander, and the transition from biasing negatively to biasing positively the speed of the second expander occur at the substantially same TRANSITION FLOW value, if the speed dependencies of the flow for two expanders are considered linear in the respective transition speed ranges.

During this transition from biasing the speed of the second expander negatively to biasing the speed of the second expander positively, the constraint that the rate of change of the speed is smaller than the maximum value of the rate of change may be observed. The newly applied positive biasing of the speed determines change of the pressure drop distribution across the two expander system. The current speed of the first expander decreases to a value equal to or smaller than SPEED_L. Thus, once the transition from biasing the speed of the second expander negatively to biasing the speed of the second expander positively is completed (taking into consideration a delay due to the constraint related to the rate of change of the speed), the current speed of the first expander is outside the undesirable range of speed. In order to allow the system to reach this state, a delay is observed at S375, similar to the delay observed at S345. The delays at S345 and S375 in FIG. 3 may be equal or have different values. The delays may be equal to the MAX_TIME. An exemplary value is 180 seconds, but other values may be used.

In some embodiments, if after the delay at S345, the current speed of the first expander is larger than SPEED_L, although the gas flow is smaller than or equal to the TRANSITION FLOW value, an alarm signal may be issued (e.g., by the controller 160 in FIG. 2).

Since the transition from biasing the speed of the second expander negatively to biasing the speed of the second expander positively likely occurs concurrently with a decrease of the gas flow, the current speed of the first expander during the transition is illustrated as a dashed arch 451 in FIG. 4, and the speed of the second expander is illustrated as a dashed arch 450 in FIG. 4.

After the transition, if the gas flow is such as the current speed of the first expander remains lower than SPEED_L, according to the comparison at S330 (i.e., the branch NO from S330), and the current speed of the first expander is larger than SPEED_LL, according to the comparison at S310 (i.e., the branch YES from S310), the speed of the second expander is set to have the positive bias at S320, etc.

According to the method illustrated in FIG. 3 and described with reference to FIG. 4, the current speed of the first expander varies through the undesirable range as fast as the maximum rate of change of the speed allows, when the gas flow passes through the TRANSITION FLOW value. Therefore, a transition time through a speed range that is unsafe for the integrity of the first expander is decreased compared to when expander speeds are equal and correlated only with the rate at which the gas flow varies.

Figure 5:
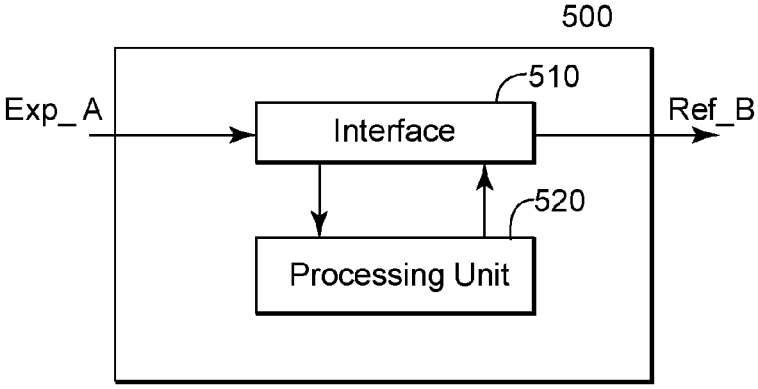
FIG. 5 is a schematic diagram of a controller, according to an embodiment.

According to an embodiment, as illustrated in FIG. 5, a controller 500 (e.g., 160 in FIG. 2) includes an interface 510 and a processing unit 520. The controller may be connected to a system of two expanders (e.g., 100 in FIG. 2), in which a first expander (e.g., 110 in FIG. 2) outputs gas to a second expander (e.g., 120 in FIG. 2), each of the first and second expanders including impellers (e.g., 122 and 124 in FIG. 2) rotating with speeds correlated with a gas flow passing through the system of two expanders.

The interface 510 may be configured to receive information about a current speed of a first expander, and to output a set speed of the second expander (e.g., to the regulator 140 in FIG. 2).

The processing unit 520 may be configured to be connected to the interface 510, and to determine the set speed of the second expander based on the process described above using FIGS. 3 and 4. The processing unit 520 may determine the set speed of the second expander to be larger than the current speed of the first expander, when the current speed of the first expander is within a bias application range (e.g., between SPEED_LL and SPEED_HH as illustrated in FIG. 4) and the fluid flow is smaller than a predetermined flow value (e.g., TRANSITION FLOW in FIG. 4). In this case, the set speed of the second expander is a sum of the current speed of the first expander and a positive bias.

The processing unit 520 may determine the set speed of the second expander to be smaller than the current speed of the first expander, when the fluid flow is larger than the predetermined value and the current speed of the first expander is within the bias application range. Thus, in this case, the set speed of the second expander is a difference between the current speed of the first expander and a negative bias.

In one embodiment, the processing unit 520 may be further configured to compare the current speed with a first speed value (e.g., SPEED_L in FIG. 4) to determine whether the fluid flow increases towards and reaches the predetermined flow value when the current speed increases towards and reaches the first speed value. The processing unit 520 may also be further configured to compare the current speed with a second speed value (e.g., SPEED_H in FIG. 4) to determine whether the fluid flow decreases towards and reaches the predetermined flow value when the current speed decreases towards and reaches the second speed value. A speed range that is unsafe for the first expander's integrity may be between the first speed value and the second speed value, and is preferably included in the bias application range.

In another embodiment, the processing unit 520 may further be configured to determine the set speed of the second expander to be equal to the current speed of the first expander when the current speed of the first expander is outside the bias application range.

In another embodiment, the processing unit 520 may further be configured to generate an alarm when the current speed of the first expander remains within the speed range that is unsafe for the first expander's integrity longer than a predetermined time interval.

In another embodiment, the processing unit 520 may further be configured to determine the set speed of the second expander such that a difference between the set speed and the current speed of the first expander to be proportional with a difference between the current speed and a lowest speed value (e.g., SPEED_LL in FIG. 4) in the bias application range, when the fluid flow is smaller than the predetermined flow value.

In another embodiment, the processing unit 520 may further be configured to determine the set speed of the second expander such that a difference between the current speed of the first expander and the speed set for the second expander is proportional with a difference between a highest speed value (e.g., SPEED_HH in FIG. 4) in the bias application range and the current speed of the first expander, when the fluid flow is larger than the predetermined flow value.

In another embodiment, the processing unit 520 may further be configured to determine the set speed of the second expander such that a rate of changing the speed to be lower than a predetermined maximum rate value.

In another embodiment, the processing unit 520 may further be configured to determine the set speed of the second expander for a plurality bias application ranges and corresponding predetermined flow values of the fluid flow.

Figure 6:
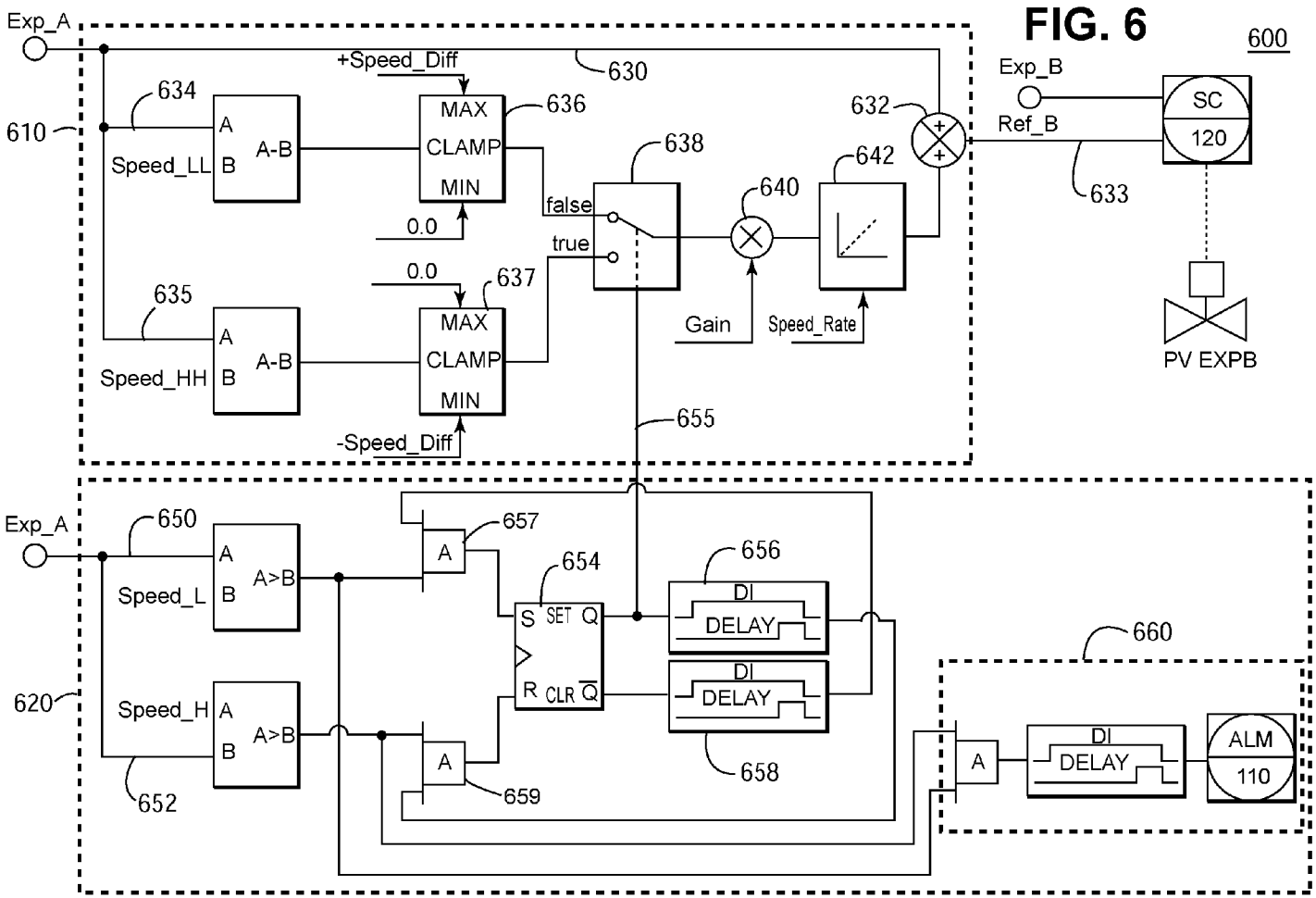
FIG. 6 is a scheme illustrating an electronic device, according to another embodiment.

According to another embodiment, FIG. 6 is a scheme illustrating an electronic device 600 configured to perform the method in FIG. 3. The electronic device 600 is made of electronic components, and is capable to convert a first expander speed signal including a current speed of a first expander (Exp_A) into a second expander speed signal including a speed to be set to a second expander (Ref_B).

The electronic device 600 includes a second expander signal generation block 610 and a bias switch signal generation block 620, both blocks receiving the first expander speed signal (Exp_A).

The second expander signal generation block 610 includes components arranged along three paths to perform different functions. The components along a first path 630 are configured to forward the first expander speed signal to an add circuit 632. The components along a second path 634 are configured to generate a signal proportional with a difference between the current speed of the first expander and a low limit (SPEED_LL) of a bias application range. The components along a third path 635 are configured to generate a signal proportional with a difference between a high limit (SPEED_HH) of the bias application range and the current speed of the first expander.

The second path 634 and the third path 635 include clamp circuits 636 and 637, respectively. Due to the clamp circuits 635 and 637, signals output from the second path 634 and the third path 636, respectively, have a 0.0 value if the current speed of the first expander (Exp_A) is outside the bias application range (i.e., larger than SPEED__HH and smaller than SPEED__LL). Also, due to the clamp circuits 636 and 637, the second path 634 and the third path 635 output signals no larger in absolute value than a maximum allowed speed difference (SPEED__DIFF). Thus, a positive bias amount output by the second path 634 is a positive value proportional with a difference between the current speed of the first expander and the low limit (SPEED__LL) of the bias application range if the difference is larger than 0 (otherwise 0 is output). The positive bias amount is also limited to be smaller than the maximum allowed speed difference (SPEED__DIFF).

A negative bias amount output by the third path 635 is a negative value, proportional with a difference between the current speed of the first expander and the high limit (SPEED__HH) of the bias application range, if the difference is smaller than 0 (otherwise 0 is output). Also, the negative bias amount is also limited such as an absolute value to be smaller than the maximum allowed speed difference (SPEED__DIFF).

The second expander signal generation block 610 further includes a switch 638 that is configured to transmit a bias value signal, which is one of the positive bias signal received from the first path 634 or the negative bias signal received from the second path 635 depending on a bias switch signal received from the bias switch signal generation block 620. The bias value signal output from the switch 638 is then multiplied by a gain in a gain component 640. A multiplied bias signal output by the gain component 640 is then input to a filter component 642 which, if necessary, limits the multiplied bias signal such that a current rate of change of the speed not to exceed a maximum rate of change of the set speed of the second expander. A final bias signal output from the filter 642 is added to the first expander speed signal in the add circuit 632, and then provided via link 633 to the second expander 120 as signal Ref_B.

The bias signal generation block 620 includes two paths 650 and 652 which provide input to a flip-flop circuit 654. Path 650 yields a "1" or high signal to the flip-flop circuit if the current speed of the first expander is larger than a low limit (SPEED__L) of a undesirable speed range that is unsafe for the integrity of the first expander. Path 652 yields a "1" or high signal to the flip-flop circuit if the current speed of the first expander is smaller than a high limit (SPEED__H) of the undesirable speed range that is unsafe for the integrity of the first expander. When both path 650 and path 652 yield a "1" or high signal, the current speed of the first expander is in the undesirable range during a transition between being positively and being negatively biased. Therefore, no change of the bias switch signal output by the flip-flop circuit 654 occurs. The bias switch signal output by the flip-flop circuit 654 is provided along bus 655 to the switch 638. Based on the received bias switch signal, the switch 638 connects the second path 634 to the add circuit 632 if the bias switch signal indicates that the current speed of the first expander stays lower than the low limit (SPEED__L) of the undesirable speed range, and connects the third path 635 to the add circuit 632 if the bias switch signal indicates that the current speed of the first expander stays higher than the high limit (SPEED__H) of the undesirable speed range. When the current speed of the first expander becomes larger than the low limit (SPEED__L) the bias switch signal output by the flip-flop circuit 654 determines the switch 638 to connect the third path 635 (negative bias), and when the current speed of the first expander becomes smaller than the high limit (SPEED__H) the bias switch signal output by the flip-flop circuit 654 determines the switch 638 to connect the second path 634 (positive bias). Two AND blocks 657 and 659, located before the flip-flop 654, ensure switching the bias in the right direction and avoiding flickering of the bias signal generation block 620. Thus, no knowledge of the actual value of the flow is necessary.

The bias switch signal generation block 620 also includes an alarm block 660 that issues and alarm when the current speed of first expander takes values in the undesirable range for longer than a predetermined time interval. Delay circuits 656 and 658 ensure implementing steps S345 and S375 in FIG. 3, respectively.

The electronic device 600 is configured to perform the method illustrated in FIG. 3. When the current speed of the first expander (Exp_A) is outside the bias application range (i.e., smaller than SPEED__LL or larger than SPEED__HH), due to the clamp circuits 636 and 637 a 0 signal is added to the first expander speed signal in the add circuit 632. When the current speed of the first expander (Exp_A) is inside the bias application range (i.e., larger than SPEED__LL and smaller than SPEED__HH) a positive bias signal or a negative bias signal is added to the first expander speed signal in the add circuit 632.

Whether the positive bias signal or the negative bias signal is added to the first expander speed signal in the add circuit 632 depends on the bias switch signal received from the bias switch signal generation block 620, in the manner described above. The second expander speed signal is the signal output by the add circuit 632.

Figure 7:
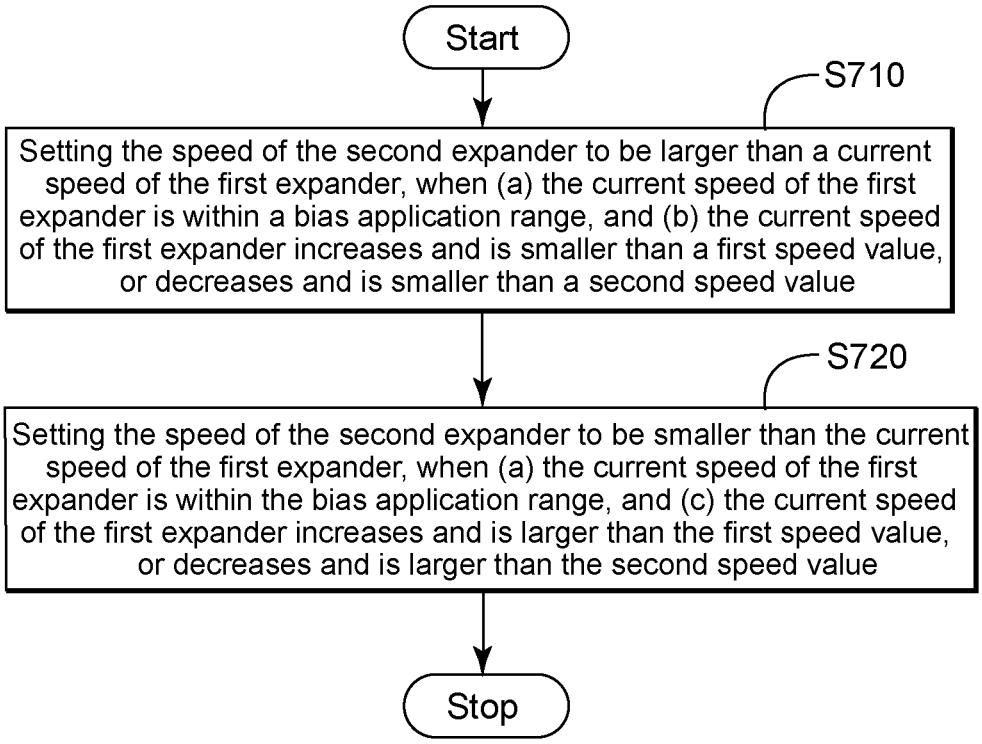
FIG. 7 is a flow diagram of a method of automatically setting the speed of a second expander that receives a fluid flow output by the first expander, according to an embodiment.

FIG. 7 is a flow diagram of a method of automatically setting the speed of a second expander that receives a fluid flow output by the first expander, to decrease a time of operating the first expander at speeds in an undesirable speed range of the first expander, according to an embodiment.

The method 700 includes setting the speed of the second expander to be larger than a current speed of the first expander, when the current speed of the first expander is within a bias application range, and the current speed of the first expander increases and is smaller than a first speed value, or decreases and is smaller than a second speed value, at S710.

The method 700 further includes setting the speed of the second expander to be smaller than the current speed of the first expander, when the current speed of the first expander is within the bias application range the current speed of the first expander increases and is larger than the first speed value, or decreases and is larger than the second speed value, at S720.

Figure 8:
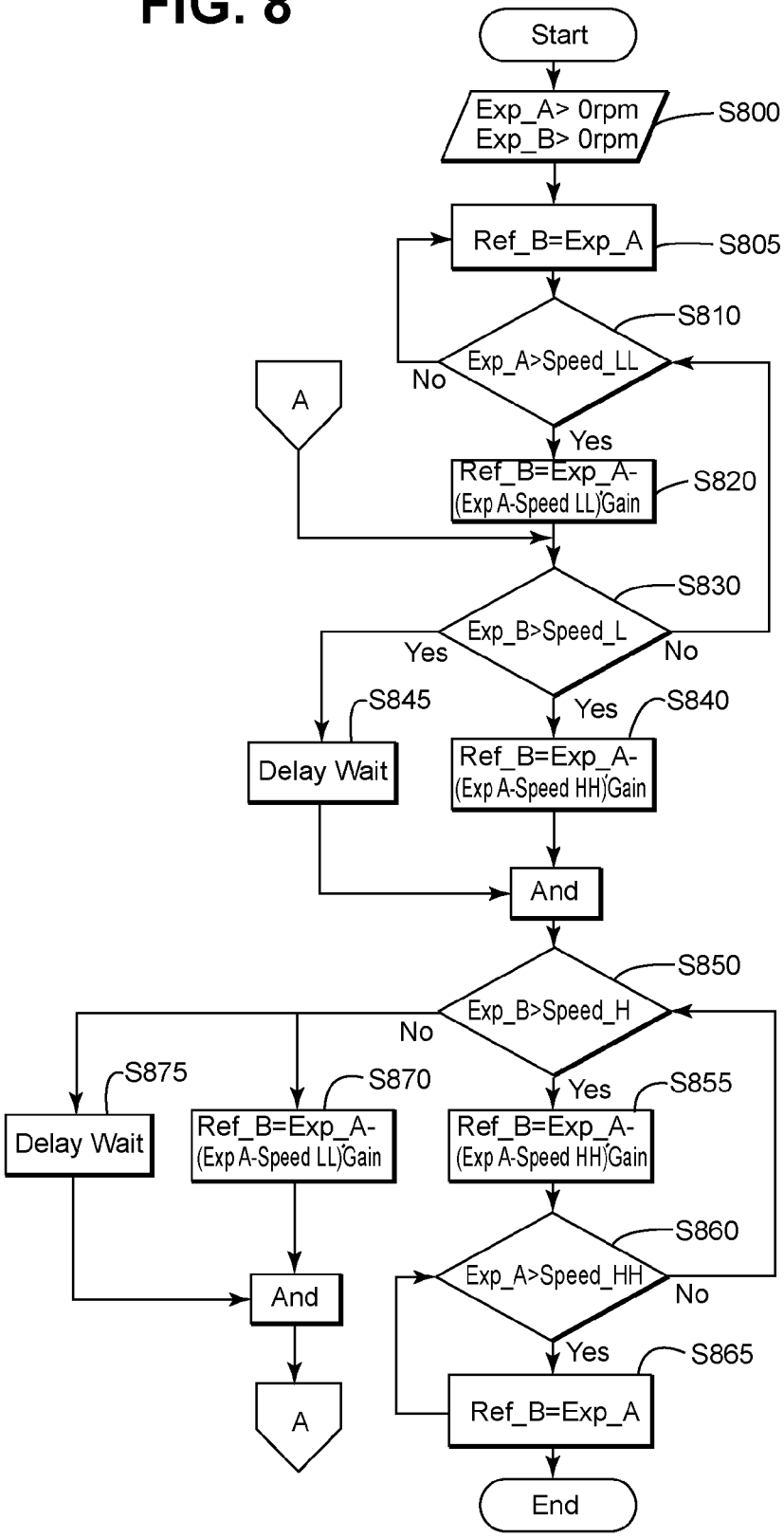
FIG. 8 is a flow diagram of a method of decreasing a transition time through a speed range around an undesirable speed that is unsafe for an integrity of a second expander, according to an embodiment.
Figure 9:
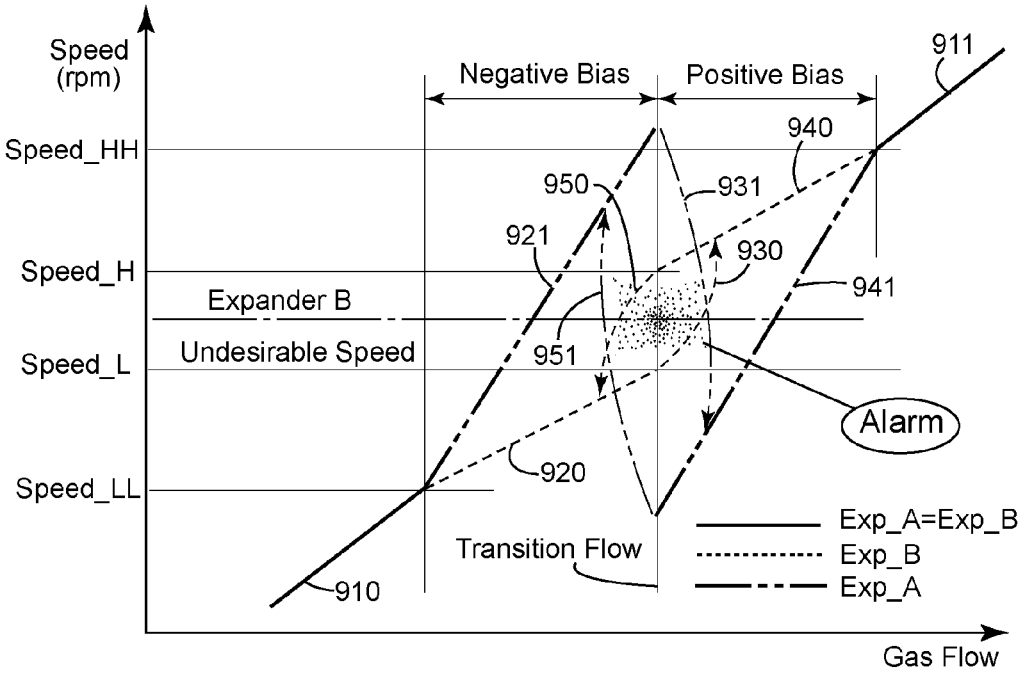
FIG. 9 is a graph representing speeds of the first and the second expander as functions of the fluid flow, according to an exemplary embodiment.

FIG. 8 is a flow diagram of a method of decreasing a transition time through a speed range that is unsafe for an integrity of the second expander, by automatically biasing a speed of a second expander that receives a fluid flow output by the first expander, according to an embodiment. The graph in FIG. 9 representing speeds of the first and the second expander as functions of the gas flow is used to describe the method in FIG. 8. A difference between the method in FIG. 3 and the method of FIG. 8 is that the first method aims to decrease a transition time through a speed range around an undesirable speed that is unsafe for an integrity of a first expander, while the second method aims to decrease a transition time through a speed range around an undesirable speed that is unsafe for an integrity of a second expander.

Speed values expressed in some rotational speed units such as, in rotation per minute (rpm) units, are illustrated on the y axis of the graph in FIG. 9. Four representative speed values are marked and labeled along the y axis, and these speeds satisfy the following relationships: SPEED__LL<SPEED__L<SPEED__H<SPEED__HH. An undesirable speed of the second expander (UNDESIRABLE SPEED) is a value included in an undesirable speed range, between SPEED_L and SPEED_H. The undesirable range may be specified by the manufacturer or predetermined based on testing and experience.

When the current speed of the first expander is within a bias application range, between SPEED_LL and SPEED_HH, the speed of the second expander is set to be biased, that is, different from the current speed of the first expander. When the current speed of the first expander is outside the bias application range, the speed of the second expander is set to be equal to the current speed of the first expander.

In addition to specifying the undesirable range, manufacturers of expanders usually specify an undesirable time (MAX_TIME), which is a maximum time interval during which an expander is allowed to operate at speeds inside the undesirable range. The manufacturers of expanders also usually specify a maximum allowed rate of a speed change (SPEED_RATE) for the expander (e.g., the first expander).

In order to be able to operate the system such as to comply with both the maximum allowed rate of change of the speed (SPEED_RATE) constraint, and the undesirable time (MAX_TIME) constraint, the maximum allowed rate of change of the speed (SPEED_RATE) should be larger than (SPEED_H-SPEED_L)/MAX_TIME.

Also, the manufacturer (if the two expander system is provided as a whole by the same manufacturer) or a process engineer (if the two expander system is assembled by a user) determines a maximum allowed speed difference (SPEED_DIFF) between the speeds of the first and second expanders. That is, in the two-expander system (e.g., 100 in FIG. 2), an absolute difference between the speeds of the first expander and the speed of the second expander should be, for normal operating conditions, smaller than a maximum SPEED_DIFF. In order to be able to operate the system such as to comply with this maximum allowed speed difference (SPEED_DIFF) constraint, the maximum allowed speed difference (SPEED_DIFF) should be larger than SPEED_H-SPEED_L.

The gas flow through the expanders is represented on the x axis of the graph in FIG. 9. In FIG. 9, the speeds of the expanders have a linear dependence of the gas flow. However, the linear dependence is only an exemplary illustration of a correlation function of the speeds of the expanders with the gas flow. The correlation function may have other functional dependence, but generally, when the gas flow increases the speeds of the expanders increase, and when the gas flow decreases, the speeds of the expanders decrease.

When the system starts operating (i.e., gas starts flowing through the expanders) the speeds of the expanders become positive (i.e., greater than 0 rpm), at S800 in FIG. 8. At low gas flow, while the speed of the expanders are below the bias application range, the speed of the second expander (Ref_B) is set (e.g., by the regulator 140 based on a signal received from the controller 160 in FIG. 2) to be equal with a current speed of the first expander (Exp_A) at step S805. The current speed of the first expander may be received by the controller 160 in FIG. 2, from a speed sensor such as Sv1 150 in FIG. 2. However, information on the current speed of the first expander may be received from other sources of information such as a control panel, estimated, calculated, etc.

As long as the current speed of the first expander (e.g., 110 in FIG. 2) is outside the bias application range (i.e., smaller than SPEED_LL or larger than SPEED_HH), a speed of the second expander (e.g., 120 in FIG. 2) is set (e.g., by the regulator 140 based on the value received from the controller 160) to be the same as the current speed of the first expander, situations which correspond to segments 910 and 911 in FIG. 9.

If a comparison of the current speed of the first expander with the SPEED_LL at step S810 in FIG. 8 indicates that the current speed of the first expander is smaller than SPEED_LL (i.e., the branch NO from S310), the speed of the second expander (Ref_B) is set to be equal with the current speed of the first expander (Exp_A) at step S805.

At a higher gas flow, when the current speed of the first expander (Exp_A) becomes larger than SPEED_LL (i.e., the branch YES from S810), the speed of the second expander (Ref_B) is set to a value smaller than the current speed of the first expander at step S820. Specifically, the speed of the second expander is set to be Ref_B=Exp_A−(Exp_A−SPEED_LL)×GAIN, where GAIN is a predetermined positive value. The quantity (Exp_A−SPEED_LL)×GAIN is a negative bias applied to the speed of the second expander. Thus, the negative bias is proportional with a difference between the current speed of the first expander and the lower limit of the bias application range (i.e., SPEED_LL). In other applications, the negative bias may be determined a different manner. In general, the negative bias may be a function of the current speed of the first expander (Exp_A), the lowest value of the bias application range (SPEED_LL), the lowest value of the undesirable speed range (SPEED_L), gain, etc., e.g., f(Exp_A, SPEED_LL, SPEED_L, GAIN).

The GAIN may be predetermined to be one minus a ratio of the difference SPEED_H-SPEED_L and the maximum allowed speed difference (SPEED_DIFF). An exemplary value of the GAIN is 0.7.

At S820, when the speed of the second expander is biased, the controller (e.g., 160 in FIG. 2) is configured to output a speed value such that an absolute value of a current rate of change of the speed of the second expander is smaller than the maximum rate of change of the speed for the second expander (SPEED_RATE). The maximum rate of change of the speed for the second expander (SPEED_RATE) may be, for example, a value between 20 and 50 rpm/s. Thus, even if the gas flow increases at a fast rate, the speed of the second expander is set to decrease gradually in time to comply with the maximum allowed rate of change of the speed (SPEED_RATE) constraint.

Due to the negatively biased speed of the second expander, the distribution of the pressure drop across the system may change compared to a state when no bias was applied, although the total pressure drop may remain substantially the same. Thus, the current speed of the first expander for a given gas flow becomes smaller than a value of the current speed that the first expander would have had, if no bias were applied to the speed of the second expander at that given gas flow.

As long as a comparison of a current speed of the second expander (Exp_B) with SPEED_L at S830 indicates that the speed of the second expander is lower than SPEED_L (i.e., the branch NO from S830), and the comparison of the current speed of the first expander with SPEED_LL at S810 indicates that the current speed of the first expander is larger than SPEED_LL, the speed of the second expander (Ref_B) is set to include the negative bias (i.e., to be negatively biased). The current speed of the second expander may be measured by a sensor, or may be considered to be the most recent previously set speed of the second expander (Ref_B).

The speed of the second expander as a function of flow when the speed of the second expander is negatively biased corresponds to segment 920 in FIG. 9, and the current speed of the first expander in this situation corresponds to segment 921 in FIG. 9. Note that by applying the negative bias to the speed of the second expander (as illustrated by segment 920), the current speed of the second expander remains smaller than SPEED_L, and, thus, outside the undesirable speed range.

If the comparison of the current speed of the second expander with SPEED_L at S830 indicates that the speed of the second expander is larger than SPEED_L (i.e., the branches YES from S830), the controller 160 communicates to the regulator 140 a speed value that increases at a rate of change of the speed smaller than SPEED_RATE to become larger than the current speed of the first expander at step S840, and waits for a delay at S845. Specifically, the speed of the second expander is set to be Ref_B=Exp_A−(Exp_A−SPEED_HH)×GAIN. The quantity (Exp_A−SPEED_HH)×GAIN is a negative quantity, and, therefore Ref_B is set to be larger than Exp_A (i.e., the speed of the second expander is positively biased).

The transition from biasing the speed of the second expander negatively to biasing the speed of the second expander positively may be performed while observing the constraint related to the maximum rate of change of the speed. That is, an absolute value of the rate of change of the speed of the second expander may be maintained smaller than the maximum value of the rate of change (SPEED_RATE).

Given that the speeds of the first and second expanders are correlated with the gas flow, this transition occurs when the gas flow exceeds a TRANSITION FLOW value. This TRANSITION FLOW value may be determined either by calculation or by experimentation for the two-expander system. The TRANSITION FLOW value may depend on the gas composition and the expanders' efficiency, which may change in time. No direct measurement of the gas flow is required, because the TRANSITION FLOW value is a flow value at which, when the speed of the second expander is set to be negatively biased, the speed of the second expander becomes equal to a lower limit of the undesirable speed range SPEED_L. If the speed of the second expander is then set positively biased, even if the gas flow is maintained at the TRANSITION FLOW value, the speed of the second expander will increase up to the upper limit of the undesirable speed range SPEED_H.

This transition from biasing the speed of the second expander negatively to biasing the speed of the second expander positively, may change the pressure drop distribution across the two expander system, which will determine changing the current speed of the first expander on segment 941 in FIG. 9. When the transition is completed, the speed of the second expander becomes larger than SPEED_H on segment 940 in FIG. 9, and, therefore, is outside the undesirable range of speed. A delay is observed at S845 to allow the system to complete the transition. The delay may be equal to a ratio of the width of the undesirable speed interval of the second expander divided by the maximum allowed rate of change of the speed of the second expander: DELAY=(SPEED_H−SPEED_L)/SPEED_RATE.

In some embodiments, if after the delay at S845, the speed of the second expander is less than SPEED_H, although the gas flow is larger than or equal to the TRANSITION FLOW value, an alarm signal may be issued (e.g., by the controller 160 in FIG. 2).

Since the transition from biasing the speed of the second expander negatively to biasing the speed of the second expander positively likely occurs concurrently with an increase of the gas flow, the current speed of the first expander during the transition is illustrated as dashed arch 931 in FIG. 9, and the speed of the second expander is illustrated as dashed arch 930 in FIG. 9.

As long as, according to a comparison at S850, the current speed of the second expander (Exp_B) remains larger than SPEED_H (i.e., the branch YES from S850), but, according to a comparison at S860, the current speed of the first expander (Exp_A) is smaller than SPEED_HH (i.e., the branch NO from S860), the speed of the second expander is set to have the positive bias at step S855, that is: Ref_B=Exp_A−(Exp_A−SPEED_HH)×GAIN.

The speed of the second expander as a function of flow in this situation corresponds to segment 940 in FIG. 9, and the current speed of the first expander in this situation corresponds to segment 941 in FIG. 9. Note that by applying the positive bias to the speed of the second expander (as illustrated by the segment 940), the speed of the second expander remains larger than SPEED_H, and, thus, outside the undesirable speed range (as illustrated by segment 940 in FIG. 9).

When, according to the comparison at S860, the current speed of the first expander is larger than SPEED_HH (i.e., the branch YES from S860), the speed of the second expander is set to be equal to the current speed of the first expander, at S865.

If, according to the comparison at S850, the speed of the second expander is smaller than SPEED_H (i.e., the branch NO from S850), the speed of the second expander is no longer biased positively, and it is again biased negatively (Ref_B=Exp_A−(Exp_A−SPEED_LL)×GAIN) at S870. In order to avoid having the system flipping back and forth between biasing the speed of the second expander positively and negatively, the transition from biasing positively to biasing negatively the speed of the second expander, and the transition from biasing negatively to biasing positively the speed of the second expander occur at the substantially same TRANSITION FLOW value, if the speed dependencies of the flow for two expanders are considered linear in the respective transition speed ranges.

During this transition from biasing the speed of the second expander positively to biasing the speed of the second expander negatively, the constraint that an absolute value of the rate of change of the speed is smaller than the maximum value of the rate of change may be observed. The newly applied negative biasing of the speed determines change of the pressure drop distribution across the two expander system. The current speed of the first expander increases. Once the transition from biasing the speed of the second expander positively to biasing the speed of the second expander negatively is completed (taking into consideration a delay due to the constraint related to the rate of change of the speed), the speed of the second expander is outside the undesirable range of speed. In order to allow the system to reach this state, a delay is observed at S875, similar to the delay observed at S845. The delays at S845 and S875 in FIG. 8 may be equal or have different values. The delay may be equal to the MAX_TIME.

In some embodiments, if after the delay at S845, the speed of the second expander is smaller than SPEED_H, although the gas flow is smaller than or equal to the TRANSITION FLOW value, an alarm signal may be issued (e.g., by the controller 160 in FIG. 2).

Since the transition from biasing the speed of the second expander positively to biasing the speed of the second expander negatively likely occurs concurrently with a decrease of the gas flow, the current speed of the first expander during the transition is illustrated as dashed arch 951 in FIG. 9, and the speed of the second expander is illustrated as dashed arch 950 in FIG. 9.

After the transition, if the gas flow is such as the speed of the second expander remains lower than SPEED_L, according to the comparison at S830 (i.e., the branch NO from S830), and the current speed of the first expander is larger than SPEED_LL, according to the comparison at S810 (i.e., the branch YES from S810), the speed of the second expander is set to have the negative bias at S820, etc.

According to the method illustrated in FIG. 8 and described with reference to FIG. 9, the speed of the second expander varies through the undesirable range as fast as the maximum rate of change of the speed allows, when the gas flow passes through the TRANSITION FLOW value. Therefore, a transition time through a speed range that is unsafe for the integrity of the second expander is decreased compared to when speeds of the expanders are equal and correlated only with the rate at which the gas flow varies.

Figure 10:
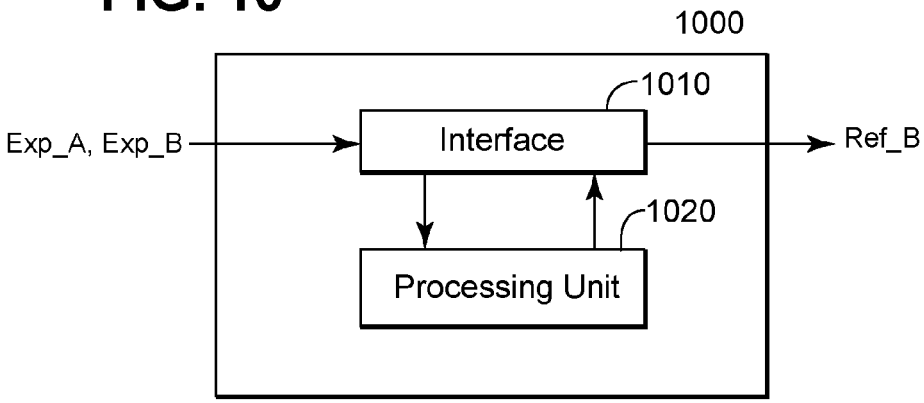
FIG. 10 is a schematic diagram of a controller, according to an embodiment.

According to an embodiment, as illustrated in FIG. 10, a controller 1000 (e.g., 160 in FIG. 2) includes an interface 1010 and a processing unit 1020. The controller may be connected to a system of two expanders (e.g., 100 in FIG. 2), in which a first expander (e.g., 110 in FIG. 2) outputs gas to a second expander (e.g., 120 in FIG. 2), each of the first and second expanders including impellers (e.g., 122 and 124 in FIG. 2) rotating with speeds correlated with a gas flow passing through the system of two expanders.

The interface 1010 may be configured to receive information about a current speed of a first expander, and to output a set speed of the second expander (e.g., to the regulator 140 in FIG. 2). In an embodiment, the interface may also receive information on a current speed of the second expander. However, the current speed of the second expander may be considered to be the most recent previously set speed of the second expander.

The processing unit 1020 may be configured to be connected to the interface 1010, and to determine the set speed of the second expander based on the process described above using FIGS. 8 and 9. The processing unit 1020 may determine the set speed of the second expander to be smaller than the current speed of the first expander, when the current speed of the first expander is within a bias application range (e.g., between SPEED_LL and SPEED_HH as illustrated in FIG. 9) and the fluid flow is smaller than a predetermined flow value (e.g., TRANSITION FLOW in FIG. 9). In this case, the set speed of the second expander is a difference of the current speed of the first expander and a negative bias amount.

The processing unit 1020 may determine the set speed of the second expander to be larger than the current speed of the first expander, when the fluid flow is larger than the predetermined value and the current speed of the first expander is within the bias application range. Thus, in this case, the set speed of the second expander is a sum of the current speed of the first expander and a positive bias amount.

In one embodiment, the processing unit 1020 may be further configured to compare the speed of the second expander with a first speed value (e.g., SPEED_L in FIG. 9) to determine whether the fluid flow increases towards and reaches the predetermined flow value when the speed increases towards and reaches the first speed value. The processing unit 1020 may also be further configured to compare the speed of the second expander with a second speed value (e.g., SPEED_H in FIG. 9) to determine whether the fluid flow decreases towards and reaches the predetermined flow value when the speed decreases towards and reaches the second speed value. A speed range that is unsafe for the second expander's integrity may be between the first speed value and the second speed value.

In another embodiment, the processing unit 1020 may further be configured to determine the set speed of the second expander to be equal to the current speed of the first expander when the current speed of the first expander is outside the bias application range.

In another embodiment, the processing unit 1020 may further be configured to generate an alarm when the speed of the second expander remains within the speed range that is unsafe for the second expander's integrity longer than a predetermined time interval.

In another embodiment, the processing unit 1020 may further be configured to determine the set speed of the second expander such that an absolute value of difference between the set speed of the second expander and the current speed of the first expander to be proportional with a difference between the current speed of the first expander and a lowest speed value (e.g., SPEED_LL in FIG. 9) in the bias application range, when the fluid flow is smaller than the predetermined flow value.

In another embodiment, the processing unit 1020 may further be configured to determine the set speed of the second expander such that an absolute value of a difference between the current speed of the first expander and the speed set for the second expander is proportional with a difference between a highest speed value (e.g., SPEED_HH in FIG. 9) in the bias application range and the current speed of the first expander, when the fluid flow is larger than the predetermined flow value.

In another embodiment, the processing unit 1020 may further be configured to determine the set speed of the second expander such that an absolute value of a rate of changing the speed of the second expander to be lower than a predetermined maximum rate value.

In another embodiment, the processing unit 1020 may further be configured to determine the set speed of the second expander for a plurality bias application ranges and corresponding predetermined flow values of the fluid flow.

Figure 11:
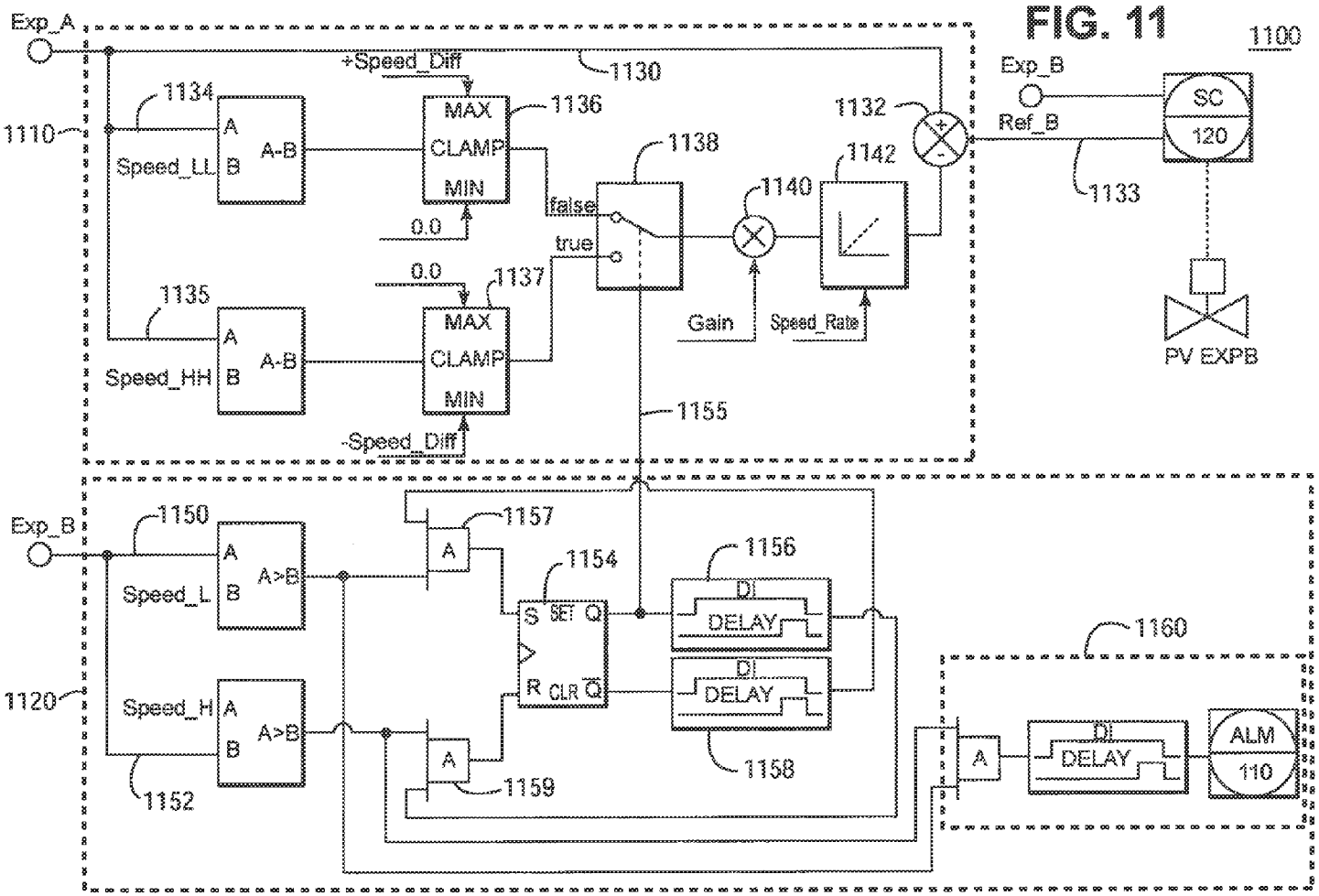
FIG. 11 is a scheme illustrating an electronic device, according to another embodiment.

According to another embodiment, FIG. 11 is a scheme illustrating an electronic device 1100 configured to perform the method in FIG. 8. The electronic device is made of electronic components, and is capable to convert a first expander speed signal including a current speed of a first expander (Exp_A) and the current speed of a second expander (Exp_B) into a second expander speed signal including a set speed of a second expander (Ref_B).

The electronic device 1100 includes a second expander signal generation block 1110 and a bias switch signal generation block 1120. The second expander signal generation block 1110 receives the first expander speed signal (Exp_A), and the bias switch signal generation block 1120 receives a current speed of the second expander (Exp_B). The current speed of the second expander may be measured by a sensor, or may be considered to be the most recent previously set speed of the second expander.

The second expander signal generation block 1110 includes components arranged along three paths to perform different functions. The components arranged along a first path 1130 are configured to forward the first expander speed signal to an add/subtract circuit 1132. The components arranged along a second path 1134 are configured to generate a signal proportional with a difference between the current speed of the first expander and a low limit (SPEED_LL) of a bias application range. The components arranged along a third path 1135 are configured to generate a signal proportional with a difference between a high limit (SPEED_HH) of the bias application range and the current speed of the first expander.

The second path 1134 and the third path 1135 include clamp circuits 1136 and 1137, respectively. Due to the clamp circuits 1135 and 1137, signals output from the second path 1134 and the third path 1136, respectively, have a 0.0 value if the current speed of the first expander (Exp_A) is outside the bias application range (i.e., larger than SPEED_HH and smaller than SPEED_LL). Also, due to the clamp circuits 1136 and 1137, the second path 1134 and the third path 1135 output signals no larger in absolute value than a maximum allowed speed difference (SPEED_DIFF). Thus, a negative bias amount output by the second path 1134 is a positive value proportional with a difference between the current speed of the first expander and the low limit (SPEED_LL) of the bias application range if the difference is larger than 0 (otherwise 0 is output). The negative bias amount is also limited such as an absolute value to be smaller than the maximum allowed speed difference (SPEED_DIFF).

The positive bias amount output by the third path 1135 is a negative value, proportional with a difference between the current speed of the first expander and the high limit (SPEED_HH) of the bias application range, if the difference is smaller than 0 (otherwise 0 is output), and an absolute value of the difference is smaller than the maximum allowed speed difference (SPEED_DIFF).

The second expander signal generation block 1110 further includes a switch 1138 configured to transmit a bias value signal, which is one of the signals received from the first path 1134 or from the second path 1135 depending on a bias switch signal received from the bias switch signal generation block 1120. The bias value signal output from the switch 1138 is then multiplied by a gain in a gain component 1140. A multiplied bias signal output by the gain component 1140 is then input to a filter component 1142 which limits the scaled bias signal such that a current rate of change of the speed of the second expander not to exceed a maximum rate of change of the set speed of the second expander. A final bias signal output from the filter 1142 is subtracted from the first expander speed signal in the add/subtract circuit 1132, and then provided via link 1133 to the second expander 120 as signal Ref_B.

The bias signal generation block 1120 includes two paths 1150 and 1152 which provide input to a flip-flop circuit 1154. Path 1150 yields a "1" or high signal to the flip-flop circuit 1154 if the current speed of the second expander is larger than a low limit (SPEED_L) of a undesirable speed range that is unsafe for the integrity of the second expander. Path 1152 yields a "1" or high signal to the flip-flop circuit 1154 if the current speed of the second expander is smaller than a high limit (SPEED_H) of the undesirable speed range that is unsafe for the integrity of the second expander. When both path 1150 and path 1152 yield a "1" or high signal, the current speed of the second expander is in the undesirable range during a transition between being positively and being negatively biased. Therefore, no change of the bias switch signal output by the flip-flop circuit 1154 occurs. The bias switch signal output by the flip-flop circuit 1154 is provided along bus 1155 to the switch 1138. Based on the received bias switch signal, the switch 1138 connects the second path 1134 to the add/subtract circuit 1132 if the bias switch signal indicates that the current speed of the second expander is lower than the low limit (SPEED_L) of the undesirable speed range, and connects the third path 1135 to the add circuit 1132 if the bias switch signal indicates that the current speed of the second expander is lower than the high limit (SPEED_H) of the undesirable speed range. Two AND blocks 1157 and 1159, located before the flip-flop 1154, ensure switching the bias in the right direction and avoiding flickering of the bias signal generation block 1120. Thus, no knowledge of the actual value of the flow is necessary.

The bias switch signal generation block 1120 also includes an alarm block 1160 that issues and alarm when the current speed of second expander takes values in the undesirable range for longer than a predetermined time interval. Delay circuits 1156 and 1158 ensure implementing steps S845 and S875 in FIG. 8, respectively.

The electronic device 1100 is configured to perform the method illustrated in FIG. 8. When the current speed of the first expander (Exp_A) is outside the bias application range (i.e., smaller than SPEED_LL or larger than SPEED_HH), due to the clamp circuits 1136 and 1137 a 0 signal is added to the first expander speed signal in the add/subtract circuit 1132. When the current speed of the first expander (Exp_A) is inside the bias application range (i.e., larger than SPEED_LL and smaller than SPEED_HH) a positive bias signal or a negative bias signal is added to the first expander speed signal in the add/subtract circuit 1132.

Whether the positive bias signal or the negative bias signal is added to the first expander speed signal in the add/subtract circuit 1132 depends on the bias switch signal received from the bias switch signal generation block 1120, in the manner described above. The second expander speed signal is the signal output by the add circuit 1132.

Figure 12:
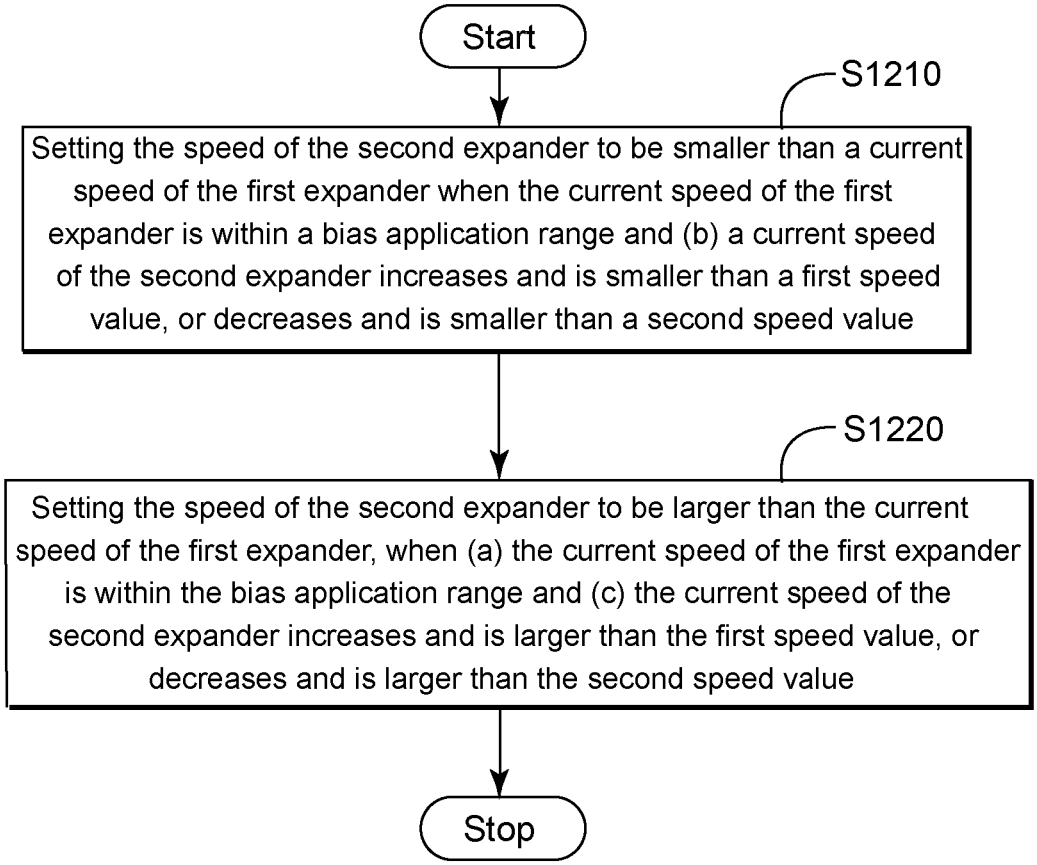
FIG. 12 is a flow diagram of a method of automatically setting the speed of a second expander that receives a fluid flow output by the first expander, according to an embodiment.

FIG. 12 is a flow diagram of a method of automatically setting the speed of a second expander that receives a fluid flow output by the first expander, to decrease a time of operating the second expander at speeds in a undesirable speed range of the second expander, according to an embodiment.

The method 1200 includes setting the speed of the second expander to be smaller than a current speed of the first expander, when the current speed of the first expander is within a bias application range, and a current speed of the second expander increases and is smaller than a first speed value, or decreases and is smaller than a second speed value, at S1210.

The method 1200 further includes setting the speed of the second expander to be larger than the current speed of the first expander, when the current speed of the first expander is within the bias application range and the current speed of the second expander increases and is larger than the first speed value, or decreases and is larger than the second speed value, at S1220.

The disclosed exemplary embodiments provide a method, a controller and a device decreasing a transition time through a speed range that is unsafe for an integrity of a first expander, by automatically biasing a speed of a second expander that receives a fluid flow output by the first expander. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

The above-described methods may be implemented in hardware, software, firmware or a combination thereof.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A method of controlling a transition time through a speed range that is unsafe for an integrity of a second expander that receives a fluid flow from a first expander, by automatically biasing a speed of the second expander, the method comprising:

setting the speed of the second expander to be smaller than a current speed of the first expander, when (a) the current speed of the first expander is within a bias application range, and (b) a current speed of the second expander increases and is smaller than a first speed value, or decreases and is smaller than a second speed value; and setting the speed of the second expander to be larger than the current speed of the first expander, when (a) the current speed of the first expander is within the bias application range and (c) the current speed of the second expander increases and is larger than the first speed value, or decreases and is larger than the second speed value.

2. The method of claim 1, wherein the speed range that is unsafe for the integrity of the second expander is between the first speed value and the second speed value.

3. The method of claim 1, further comprising:

setting the speed of the second expander to be equal to the current speed of the first expander when the current speed of the first expander is outside the bias application range.

4. The method of claim 1, further comprising:

sending an alarm signal when the current speed of the second expander is in the speed range that is unsafe for the integrity of the second expander longer than a predetermined time interval.

5. The method of claim 1, wherein a negative bias, which is a difference between the current speed of the first expander and the speed set for the second expander is proportional with a difference between (i) the current speed of the first expander and (ii) a lowest speed value in the bias application range when the speed of the second expander is set to be larger than the current speed of the first expander.

6. The method of claim 1, wherein a positive bias which is a difference between the current speed of the first expander and the speed set for the second expander is proportional with a difference between (i) a highest speed value in the bias application range and (ii) the current speed of the first expander, when the speed of the second expander is set to be smaller than the current speed of the first expander.

7. The method of claim 1, wherein a rate of changing of the speed set for the second expander is maintained below a predetermined maximum rate value.

8. The method of claim 1, wherein the speed of the second expander is automatically set to be different than the current speed of the first expander for a plurality of bias application ranges and corresponding pairs of the first speed value and the second speed value.

9. A controller, comprising:

an interface configured to receive information about a current speed of a first expander, and output a set speed for the second expander, the second expander receiving a fluid flow output from the first expander; and a processing unit connected to the interface and configured to determine the set speed of the second expander to be smaller than the current speed of the first expander, when (a) the current speed of the first expander is within a bias application range, and, (b) a current speed of the second expander increases and is smaller than a first speed value, or decreases and is smaller than a second speed value, and to be larger than the current speed of the first expander, when (a) the current speed of the first expander is within the bias application range, and (c) the current speed of the second expander increases and is larger than the first speed value, or decreases and is larger than the second speed value.

10. The controller of claim 9, wherein the speed range that is unsafe for the second expander's integrity is between the first speed value and the second speed value, and the processing unit receives the current speed of the second expander via the interface or the current speed of the second expander is a most recent previously set speed for the second expander.

11. The controller of claim 9, wherein the processing unit is further configured to determine the set speed of the second expander to be equal to the current speed of the first expander when the current speed of the first expander is outside the bias application range.

12. The controller of claim 9, wherein the processing unit is further configured to generate an alarm when a current speed of the second expander remains within the speed range that is unsafe for the second expander's integrity longer than a predetermined time interval.

13. The controller of claim 9, wherein the processing unit is further configured to determine the set speed of the second expander such that a difference between the current speed of the first expander and the set speed to be proportional with a difference between the current speed and a lowest speed value in the bias application range when the set speed of the second expander is set to be smaller than the current speed of the first expander.

14. The controller of claim 9, wherein the processing unit is further configured to determine the set speed of the second expander such that a difference between the set speed for the second expander and the current speed of the first expander is proportional with a difference between a highest speed value in the bias application range and the current speed of the first expander, when the set speed of the second expander is set to be larger than the current speed of the first expander.

15. The controller of claim 9, wherein the processing unit is further configured to determine the set speed of the second expander such that a rate of changing the speed to be lower than a predetermined maximum rate value.

16. The controller of claim 9, wherein the processing unit is further configured to determine the set speed of the second expander for a plurality bias application ranges and corresponding pairs of a first speed value and a second speed value.

17. A device made of electronic components to convert a first expander speed signal including a current speed of a first expander into a second expander speed signal including a set speed of a second expander, the second expander receiving a fluid flow from the first expander, the device comprising:

a signal generation block configured to generate the second expander speed signal and including an add and/or subtract circuit configured to subtract a bias value signal from the first expander speed signal, a first path configured to forward the first expander speed signal to the add and/or subtract circuit, a second path configured to generate a negative bias signal, a third path configured to generate a positive bias signal, and a switch connected to outputs of the second path and the third path, and configured to connect the second path or the third path to the add and/or subtract circuit depending on a bias switch signal; and a bias switch signal generation block connected to the signal generation block, and configured to generate the bias switch signal indicating to connect the second path if the current speed of the second expander is smaller than a first value, indicating to connect the third path if the current speed of the second expander is larger than a second value, and to maintain current connection if the current speed of the second expander is larger than the first value and is smaller than the second value, wherein the second path and the third path generate a zero signal, when the current speed of the first expander is outside a bias application range.

18. The device of claim 17, further comprising:

an alarm unit configured to generate an alarm when the current speed of the second expander is higher than the first value and lower than the second value longer than a predetermined time interval.

19. The device of claim 17, further comprising:

a rate of change of speed limiting unit connected between the switch and the add and/or subtract circuit that modifies a bias value signal output by the switch to keep a rate of change of the set speed of the second expander lower than a predetermined maximum rate.

20. The device of claim 17, further comprising:

a gain applying unit connected between the switch and the add and/or subtract circuit to multiply a bias value signal output from the switch by a gain, wherein the negative bias signal is proportional with a difference between the current speed of the first expander and a lowest speed value in the bias application range, the positive bias signal is proportional with a difference between and a highest speed in the bias application range and the current speed of the first expander, and the positive bias signal and the negative bias signal are limited to be smaller than a maximum speed difference.

21. A non-transitory computer readable medium storing executable codes, which, when executed by a processor, make the computer perform a method of controlling a transition time through a speed range that is unsafe for an integrity of a second expander, by automatically biasing a speed of the second expander that receives a fluid flow output from a first expander, the method comprising:

setting the speed of the second expander to be smaller than a current speed of the first expander, when (a) the current speed of the first expander is within a bias application range, and (b) a current speed of the second expander increases and is smaller than a first speed value, or decreases and is smaller than a second speed value; and setting the speed of the second expander to be larger than the current speed of the first expander, when (a) the current speed of the first expander is within the bias application range, and (c) the current speed of the second expander increases and is larger than the first speed value, or decreases and is larger than the second speed value.

* * * * *